US010736804B2

(12) United States Patent
Kulkarni

(10) Patent No.: US 10,736,804 B2
(45) Date of Patent: Aug. 11, 2020

(54) INFANT CARE APPARATUS COOLER

(71) Applicant: General Electric Company, Schenectady, NY (US)

(72) Inventor: Kedar Anil Kulkarni, Bangalore (IN)

(73) Assignee: General Electric Company, Schenectady, NY (US)

( * ) Notice: Subject to any disclaimer, the term of this patent is extended or adjusted under 35 U.S.C. 154(b) by 565 days.

(21) Appl. No.: 15/459,484

(22) Filed: Mar. 15, 2017

(65) Prior Publication Data

US 2018/0263836 A1 Sep. 20, 2018

(51) Int. Cl.
*A61G 11/00* (2006.01)

(52) U.S. Cl.
CPC ..... *A61G 11/00* (2013.01); *A61G 11/002* (2013.01); *A61G 11/006* (2013.01); *A61G 2203/16* (2013.01); *A61G 2210/90* (2013.01)

(58) Field of Classification Search
CPC .... A61G 11/00; A61G 11/002; A61G 11/003; A61G 11/009
See application file for complete search history.

(56) References Cited

U.S. PATENT DOCUMENTS

| | | | | |
|---|---|---|---|---|
| 6,213,935 | B1 | 4/2001 | Mackin et al. | |
| 6,409,654 | B1 * | 6/2002 | McClain | A61G 11/00 600/22 |
| 2018/0168903 | A1 * | 6/2018 | Underwood | A61G 11/009 |

* cited by examiner

*Primary Examiner* — Christine H Matthews
(74) *Attorney, Agent, or Firm* — Andrus Intellectual Property Law, LLP

(57) ABSTRACT

An infant care apparatus cooler facilitates the cooling of components with elevated temperatures such as a convective heater in an infant care apparatus. The infant care apparatus includes an energy storage device and a fan. In the presence of an external source of power, the fan operates to circulate air to be heated by the heating coil and in the absence of external power, the fan is operable with energization from the energy storage device to circulate air past the heating coil, cooling the heating coil.

16 Claims, 3 Drawing Sheets

INFANT CARE APPARATUS COOLER

BACKGROUND

The present disclosure is related to the field of infant care. More specifically, the present disclosure is related to a system for cooling heated components of an incubator between uses.

Prematurely born infants require specialized treatment and care due to their small size and still-developing organs and physiological systems, thus, premature infants are placed in devices that create a carefully controlled microenvironment around the patient. The microenvironment is designed to provide one or more environmental conditions that are advantageous to the neonate beyond the ambient conditions. Infant care stations provide this microenvironment for infant patients under the operation and control of a clinician.

One type of device is generally referred to as an incubator in which the infant patient is placed within a physical enclosure and the temperature within the enclosure is carefully controlled with convective heating provided by a first flow of heated air into the enclosure.

During operation and use of a convective heater, the heater itself and surrounding components of the convective heater and the incubator are heated to temperatures in access of those temperatures desirable for contact with a technician servicing or cleaning the incubator. Thus, prior to service or cleaning, an incubator must be allowed to set with the convective heater off in order to passively cool the components before they are exposed to human contact.

BRIEF DISCLOSURE

An exemplary embodiment of a infant care apparatus includes an infant platform that defines a compartment therein. A heating coil is disposed within the compartment. An energy storage device is operable to storage energy. A fan is disposed within the compartment and configured to circulate air through the compartment and past the heating coil. A motor is physiological connected to the fan and electrically connected to the energy storage device. Energy stored in the energy storage device is provided to the motor to operate the motor to move the fan to circulate air through the compartment and past the heating coil.

An exemplary embodiment of a method of operating an infant care apparatus for cleaning includes an infant care apparatus. The infant care apparatus includes a convective heater with a heating coil and a fan operated by a motor. The method includes connecting the convective heater to an external energy source. The heating coil is operated with energization from the external energy source to generate heat. The energy storage device is charged form the external energy source. The convective heater is disconnected from the external energy source. Energization from the energy storage device is provided to the motor to operate the fan. The heating coil is cooled with air circulated by the fan.

An exemplary embodiment of a convective heater for an infant care apparatus includes a heating coil operable by an external power source to convert electrical energy to heat energy. A motor is operable by an external power source. A fan is driven by the motor to circulate air past the heating coil to heat the air. An energy storage device is operably connected to the external power source and the motor. The energy storage device is operable to store electrical energization from the external power source and release the storage electrical energization to the motor in the absence of external power to the motor.

BRIEF DESCRIPTION OF THE DRAWINGS

The drawings illustrate the best mode presently contemplated of carrying out the invention. In the drawings.

DETAILED DISCLOSURE

Figure 1:
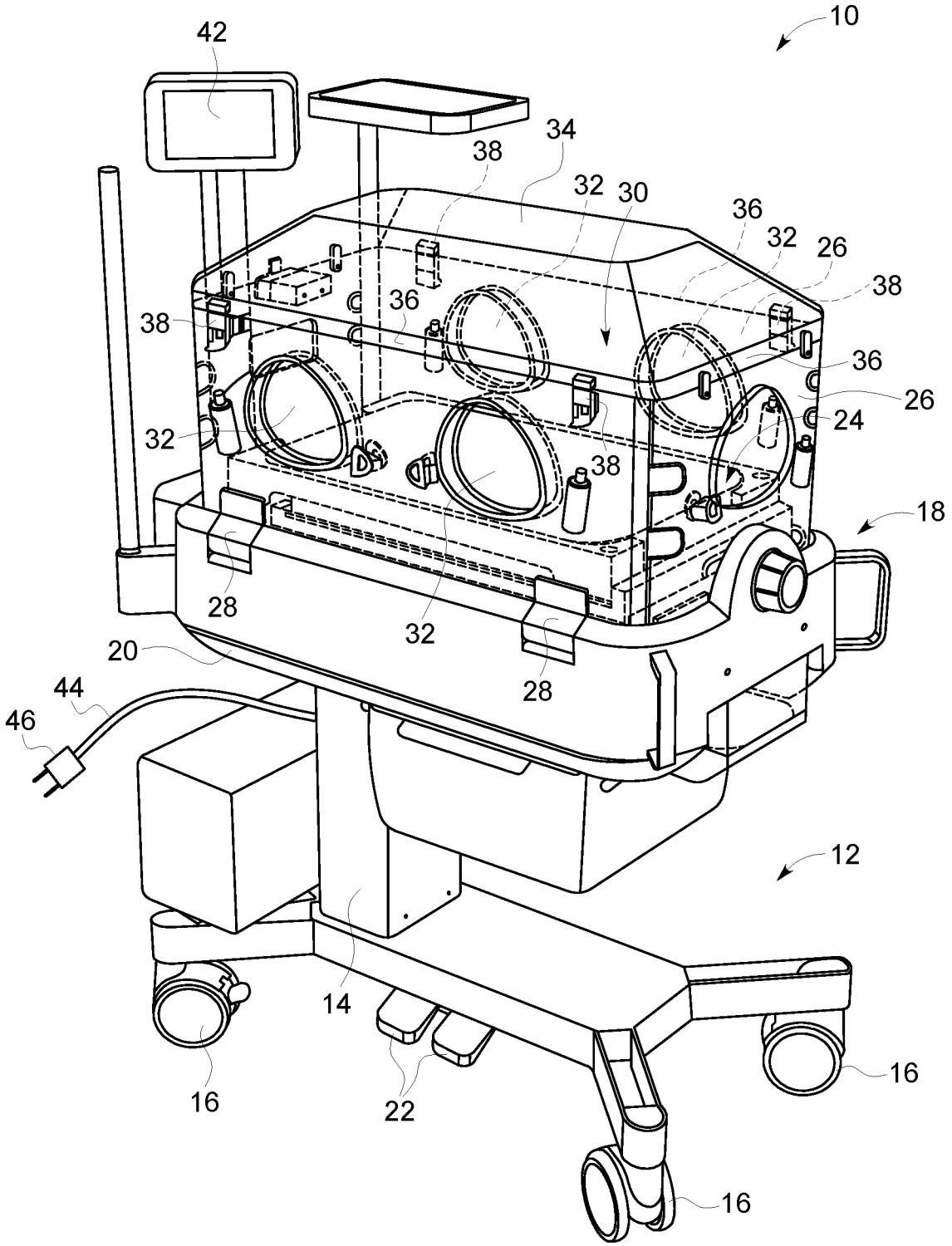
FIG. 1 is a perspective view of an exemplary embodiment of an infant care apparatus.

FIG. 1 is a perspective view of an exemplary embodiment of an infant care apparatus 10. Exemplarily, the infant care apparatus 10 is an incubator as depicted in FIG. 1 or is a hybrid warmer which at least includes a convective heater as described in further detail herein.

The infant care apparatus 10 includes a base 12 which includes a vertical base member 14. The base 12 further includes wheels 16 to facilitate movement of the infant care apparatus 10, for example between use locations, to transport and infant patient, or to move the infant care apparatus to a location for cleaning.

The infant care apparatus includes an infant platform 18 which supports an infant patient in the infant care apparatus 10. The infant platform 18 may be mounted to the base 12 in a cantilevered fashion, for example to a moveable base member 20 which is moveably secured to the vertical base member 14 and is exemplarily moveable in the vertical dimension relative thereto to adjust the height of the infant platform 18 by raising and lowering the moveable base member 20 relative to the vertical base member 14. Exemplarily foot pedals 22 are operable by the user to control the position of the moveable base member 20 and the infant platform 18 to a height preferred by the user.

The infant platform 18 includes a flat, planar surface 24 that underlies and supports the infant patient when the infant patient is positioned within the infant care apparatus 10. The planar surface 24 is exemplarily provided by a series of nested components secured within the infant platform 18 as will be described in further detail herein.

A plurality of walls 26 extend upwardly around the periphery of the infant platform 18. Exemplarily, the walls 26 are secured to the infant platform by hinges 28 about which each of the walls 26 are at least pivotable and in exemplary embodiments, the hinges 28 are separable from the infant platform 18 to facilitate removal of the walls 26 from the infant platform 18, exemplarily for cleaning. The walls 26 are exemplarily constructed of transparent plastic material and when connected to the infant platform 18, surround the flat planar surface 24 to enclose the infant patient upon the planar surface 24. The walls 26 thus define or partially define a microenvironment 30 about the infant patient. Embodiments of the walls 26 are provided with access ports 32 through which a caregiver can reach the infant patient within the microenvironment 30.

The infant care apparatus 10 further includes a canopy 34 which overlies the infant platform 18 and is exemplarily transparent or semitransparent in whole or in part. It will be recognized that in other embodiments, portions or an entirety of the canopy 34 may be opaque. In an exemplary embodiment, the canopy 34 engages vertically peripheral edges 36 of the wall 26 to further enclose the microenvironment 30. In an exemplarily embodiment, latches 38 further removably secure the canopy 34 to the walls 26.

In exemplarily embodiments, the canopy 34 is vertically moveable relative to the infant platform 18. In an exemplary embodiment this facilitates access to the planar surface 24 and the infant patient located thereon.

The infant care apparatus 10 further includes a user input device 42, which in an exemplary embodiment is a touch sensitive graphical display that is exemplarily used to present both patient as well as operational information to a clinician. The user input device 42 further is operable to receive user inputs from an operating clinician or technician including, but not limited to user inputs regarding the operation and use of the infant care apparatus 10. In embodiments, this may include providing an on/off switch for the infant care apparatus 10. In other embodiments, such a power switch may be provided as a physical switch elsewhere on the infant care apparatus 10. The infant care apparatus 10 further includes a power cord 44 that terminates in a plug 46 which is configured to be operatively connected to an outlet or other external electrical power source configured, for example to provide mains electricity to the infant care apparatus 10.

Figure 2:
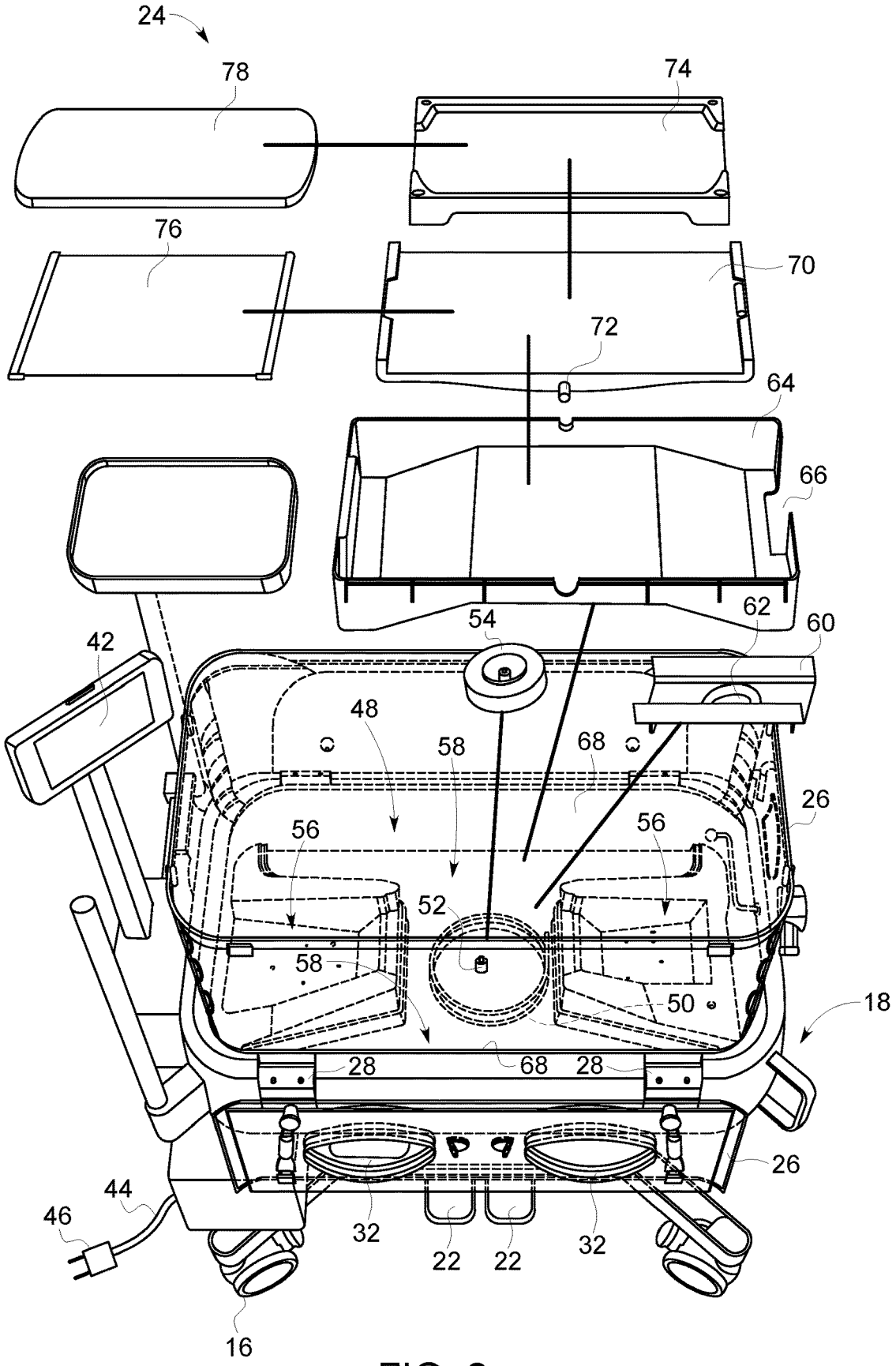
FIG. 2 is an exploded top view of an exemplary embodiment of an infant care apparatus.

FIG. 2 presents a perspective exploded view of an exemplary embodiment of an infant care apparatus 10 such as to better depict an embodiment of a heating and air moving compartment 48 of the infant platform 18 and exemplarily to depict the components therein in which exemplarily cooperate to provide the planar surface 24.

A heating coil 50 is located in a bottom of the heating and air moving compartment 48. The heating coil 50 turns electrical energy provided through the power cord 44 into heat energy which is transferred by radiation and convection from the heating coil 50 to the air and to components surrounding it. A motor shaft 52 exemplarily extends into the heating and air moving compartment 48 at a position intermediate the heating coil 50. A fan 54 engages the shaft 52 and an electrical motor (not depicted) operatively connected to the shaft 52 operates to rotate the shaft 52 and thus the fan 54 in the manners as disclosed herein to exemplarily create low pressure areas 56 and high pressure areas 58 within the heating and air moving compartment 48 to create a circulation of air flow, with the help of conducting components as described in further detail herein within the heating and air moving compartment 48 as well as the microenvironment 30 such that operation of the heating coil 50 and the fan 52 provide a convective heater to warm the microenvironment 30 provided by the infant care apparatus 10. An inlet duct 60 exemplarily connects the low pressure areas 56 within the heating and air moving compartment 48 and directs the air flow through an inlet 62 secured about the center of the fan 52. Circulation of the fan 52 forces the air outward through the heating coil 50 creating the high pressure area 58, which in combination with the low pressure are 56 circulates the heated air into the microenvironment 30. In an exemplarily embodiment, a filter (not depicted) may also be provided exemplarily in the inlet duct 60 to filter the air being drawn in from the microenvironment prior to heating and recirculation.

A duct pan 64 is received within the heating and air moving compartment 48. The duct pan 64 further defines the low pressure area 56 and high pressure area 58 within the heating and air moving compartment 48 by forming an upper wall thereto. The duct pan exemplarily includes duct opening 66 which pneumatically connects the microenvironment 30 to the low pressure area 56 to draw comparatively cooler ambient air from the microenvironment into the low pressure area 56 to be heated by heating coil 50. Additionally, the duct pan 64, when positioned within the heating and air moving compartment 48, leaves a gap between the duct pan 64 and sidewalls 68 of the heating and air moving compartment 48. This provides a pathway for airflow from the high pressure area 58 into the microenvironment 30 to provide the heated air to the microenvironment.

A tilt platform 70 is moveably secured to the duct pan 64 to provide tilting adjustment about a fulcrum 72 relative to the duct pan 64 and infant platform 18. A translation deck 74 is secured on the tilt platform 70. A moveable tray 76 is positioned between the translation deck 74 and the tilt platform 70 while a mattress pad 78 is received within the translation deck 74. In exemplary embodiments, the mattress pad 78 provides the planar surface 24 upon which the infant patient rests within the microenvironment 30.

As previously noted, regulation and best practices require infant care apparatus to be cleaned between use by different patients to limit and prevent the spread of communicable diseases between infant patients. In such cleaning process, the infant care apparatus is removed from the location in which it is used, e.g. neonatal intensive care unit (NICU) or pediatric intensive care unit (PICU) and transported to a dedicated area of a medical care facility for equipment cleaning and sterilization. For example, the wheels 16 of the infant care apparatus 10 facilitate rolling transfer of the equipment.

As previously noted, cleaning of the infant care apparatus requires disassembly of the infant care apparatus 10 for individual cleaning of each of the components exemplarily identified in FIG. 2. One drawback in this cleaning process is that disassembly of the infant care apparatus 10, particularly, those components located within the heating and air moving compartment 48 exposes the heating coil 50 and the components immediately surrounding the heating coil 50 (e.g. the fan 54, inlet duct 60, and duct pan 64 to comparatively high temperatures. In an exemplary embodiment, the heating coil 50, during operation, heats to a temperature of about 150° C. or greater. Operational temperature of the heating coil 50 to this temperature facilitates the ability of the heating coil 50 and the fan 54 to provide a temperature within the microenvironment 30 between approximately 25-40° C. However, operation and use of the infant care apparatus heats the heating coil 50 to these temperatures and also heats the surrounding components noted above to similar temperatures which could cause burns, discomfort, or other harm to a user should they touch these components at these operational temperatures. Even after the heater is no longer operating, residual heat remaining in these components can keep the temperatures of these components elevated for a comparatively long time. Therefore, cleaning protocols currently require the infant care apparatus to be held in an unenergized state for at least 30 minutes if not 45 minutes or an hour in order to provide sufficient time for these components to passively cool before disassembly of the components of the infant care apparatus 10 located in the heating and air moving compartment 48. This represents a significant amount of time wherein the infant care apparatus is unavailable for use with a patient and operational downtime associated with each transition between patient uses. Such operational and down time results in medical care facilities needing to own and maintain larger numbers of infant care apparatus inventory.

Figure 3:
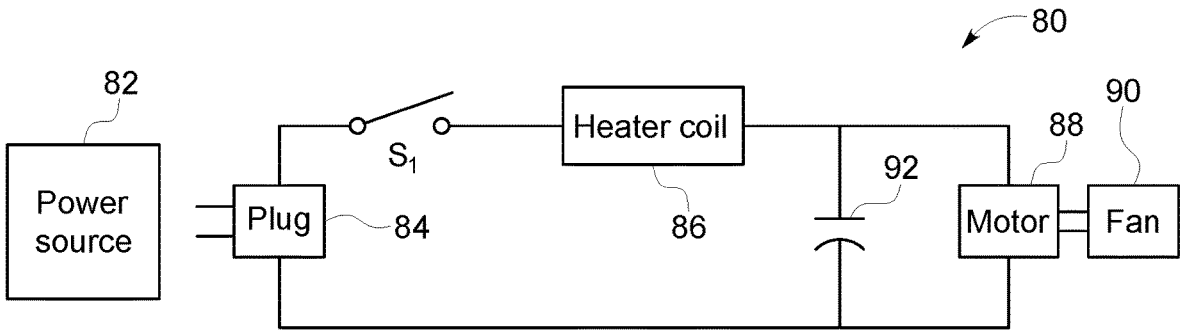
FIG. 3 is an electrical schematic diagram of an exemplary embodiment of a system for cooling and infant care apparatus.
Figure 4:
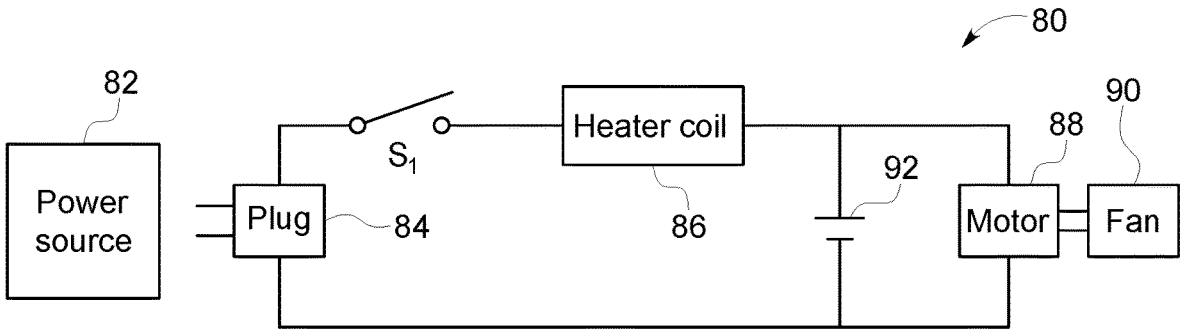
FIG. 4 depicts another exemplary embodiment of an electrical schematic diagram of a system for cooling and infant care apparatus.
Figure 5:
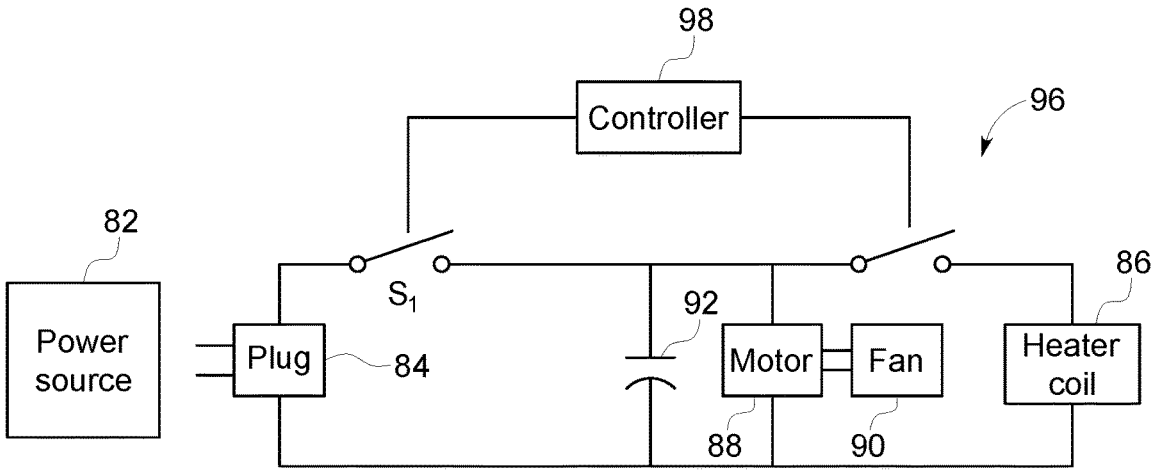
FIG. 5 depicts a still further exemplary embodiment of an electrical schematic diagram of a system for cooling an infant care apparatus.

FIGS. 3-5 depict exemplary embodiments of electrical schematic diagrams of convective heaters 80 as may be used in an infant care apparatus as described above. The convective heater 80 is configured to be selectively connected to a power source 82, exemplarily mains electricity of a medical care facility. An electrical plug 84 is connected to the convective heater 80, and to the rest of the infant care apparatus. In addition to the connection of the plug 84 to the power source 82, a power switch S1 exemplarily further controls the selective electrical connection and energization of components of the convective heater 80 by the power source 82.

As described above, the convective heater 80 includes a heater coil 86 which is exemplarily an electrical heater which converts electrical energy from the power source 82 into heat energy, exemplarily reaching a temperature of 150° centigrade or more and which is used as a source of heat to control the temperature of the microenvironment provided by the infant care apparatus to a predetermined temperature. The electrical energization is also provided to a motor 88 which is operably connected to a fan 90. The motor 88 is exemplarily an electric motor which turns a shaft to which the fan 90 is secured and operates to rotate the fan 90. Operation of the fan 90 by the motor 88 relative to the heater coil 86 draws a flow of air past the heater coil 86, heating the air. The heated air is then directed as described above into the microenvironment provided by an infant care apparatus to provide a predetermined temperature exemplarily between the range of 25-40° C. around the infant patient held within the microenvironment. In general, the convective heater 80 is operated to operate both the heater coil 86 and the fan 90 so as to provide a circulation of heated air about the infant patient and the microenvironment provided by the infant care apparatus. In some examples, for example as described in U.S. Pat. No. 6,213,935, the operation of the fan 90 may be disabled while retaining the operation of the heater coil so as to preheat components of the convective heater to improve warmup and/or other associated delays in achieving a target temperature in the microenvironment through the use of the convective heater 80.

The convective heater 80 as depicted in FIG. 3 further includes an energy storage device 92 which is exemplarily embodied as a capacitor. The capacitor 92 is exemplarily connected in parallel relative to the motor 88 and during energization of the motor 88, for example, during operation of the convective heater 80, the capacitor 92 stores a charge therein. In still other examples, the capacitor 92 may be connected to receive and store an electrical charge any time that the convective heater 80 is electrically connected to a power source 82.

Upon disconnection of the capacitor 92 from electrical energization, the capacitor 92 releases the energization to the motor 88, which continues to drive the fan 90. In the absence of electrical energization to the convective heater 80, the heater coil 86 does not operate to continue to generate heat and begins to passively cool by dissipation of heat energy from the heater coil 86 into its surroundings. By continuing to power the motor 88 driving the fan 90 with the electrical energization from the capacitor 92, the fan 90 continues to circulate air past the heater coil 86 which speeds the cooling of the heater coil through heat advection which increases the rate of heat exchange from the heater coil 86 by circulating comparatively cooler ambient air past the heater coil 86 as it cools. The capacitor 92 exemplarily is sized to provide energization for a duration such as to operate the motor 88 driving the fan 90 for a predetermined time. Exemplarily, this time period may be 30 minutes, while in other embodiments the time period may be less than 30 minutes while in a still further embodiment, the time period is 15 minutes or less. It has been determined that such time period is a suitable time period to cool the heater coil 86 from an operational heating temperature to a temperature of 45° C. or less. In a still further exemplarily embodiment, the heater coil 86 is cooled to within a temperature range of the general operation of target temperatures for the microenvironment of the infant care apparatus.

FIG. 4 depicts an additional exemplarily embodiment of a convective heater 80. While the convective heater 80 of FIG. 4 is similar in construction and operation as the convective heater 80 depicted and described above with respect to FIG. 3, the convective heater 80 of FIG. 4 exemplarily includes a battery 94 as the energy storage device as opposed to a capacitor 92. The convective heater 80 of FIG. 4 exemplarily operates in the same manner as described above while using a alternative example of a energy storage device. A person of ordinary skill in the art may further recognize other exemplary energy storage devices with suitable embodiments of convective heaters in view of this disclosure. In exemplary embodiments, the energy storage device 92, 94 may exemplarily power the motor 88 to drive the fan 90 to cool the heater coil 86 as described above either in the absence of external power to the heater 86 and the motor 88, for example by operation of the power switch S1, or the energy storage device 94 may similarly discharge to operate the motor 88 and fan 90 to cool the heater coil 86 in the absence of external power due to disconnection of the plug 84 from the power source 82.

FIG. 5 depicts a still further exemplarily embodiment of a convective heater 96. It will be recognized that similar components are depicted in FIG. 5 using similar reference numerals to identify like components between the embodiments for the purpose of conciseness and to focus on particular aspects of the embodiment of the convective heater 96 as depicted in FIG. 5.

The convective heater 96 similarly includes a motor 88 which drives a fan 90 to circulate air past a heater coil 86, all of which are operated with electrical energization provided from an external power source, exemplarily provided between an electrical connection between an external power source 82 and a plug 84. Additionally, an energy storage device 92 is electrically connected relative to the motor 88 such that in the presence of an external power source, the energy storage device 92 operates to store an electrical charge in the presence of external energization and releases such charge to the motor 88 in the absence of an external electrical power.

Additionally, controller 98 is provided, either as part of the convective heater 96 or as part of the larger infant care apparatus 10. The controller 98 may exemplarily be embodied as a microcontroller that performs the functions as described in further detail herein or may be provided in another manner, for example as a hardware implementation or as an integrated circuit (IC) for example as a comparator configured to determine the state of the provided electrical energization of the convective heater 96. In either event, the controller 98 is operably connected to the power switch S1 into a heater coil power switch S2, such that the controller 98 selectively operates the heater coil power switch to connect or disconnect the heater coil 86 to electrical energization. In an exemplarily embodiment, the power switch S1 can selectively be operated as well in order to provide electrical energization from the power source 82 to the motor 88 to continue operating the fan 90 to cool the heater coil before disconnection from the external power source or in the event that the plug 84 is disconnected from the power source 82 or the power switch S1 is opened, then the heater coil power switch S2 may also be open in order to disconnect the heater coil 86 from the energy storage device 92 such that electrical energization from the energy storage device 92 is directed solely to the motor 88 to operate the motor 88 to drive the fan 90 cooling the now unenergized heater coil 86. In the exemplary embodiment of the convective heater 96, the operation of the controller 98 provides flexibility in the manners in which the motor 88 may be operated to drive the fan 90 to cool the heater coil 86 when the heater coil 86 is not in use.

All of the embodiments as described above with respect to FIGS. 3-5 disclose exemplarily embodiments of convective heaters as may be used in infant care apparatus as described herein to facilitate fast cooling of the heater coil 50 and the surrounding components, including, but not limited to the fan 54, inlet duct 60, and duct pan 64 (FIG. 2) such that clinicians and/or other health care facility technicians tasked with disassembly of an infant care apparatus for cleaning and sterilization are not exposed to excessive temperatures while minimizing the downtime of the infant care apparatus as previously had been experienced when passive cooling was relied upon. In exemplarily embodiments, because the convective heaters 80, 96 as described herein are operable to cool the heater coil in the absence of external energization, the convective heater 80, 96 may exemplarily cool the heater coil and surrounding components for example as the infant care apparatus is moved from the use location to the exemplary cleaning location within the medical care facility and in many cases such components may be cooled by the time that this transport is carried out, thus no time delay need be required after transport before the cleaning and sterilization process can be started, including disassembly of the components of the infant care apparatus located within the heating and air moving compartment 48.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An infant care apparatus comprising:

an infant platform defining a compartment therein;

a heating coil disposed within the compartment;

an energy storage device operable to store energy;

a fan disposed within the compartment and configured to circulate air through the compartment and past the heating coil;

a motor physically connected to the fan and electrically connected to the energy storage device, wherein energy stored in the energy storage device is provided to the motor to operate the motor to move the fan to circulate air through the compartment and past the heating coil to cool the heating coil;

a plug configured to be physically connected to an external power source and to provide the electrical energization to the heating coil, motor, and energy storage device; and a power switch operable to selectively connect the heating coil, motor, and the energy storage device to the external power source.

2. The infant care apparatus of claim 1, wherein the energy storage device is a battery.

3. The infant care apparatus of claim 1, wherein the energy stored in the energy storage device is provided to the motor to operate the motor to move the fan to circulate air through the compartment and past the heating coil for up to 30 minutes.

4. The infant care apparatus of claim 1, wherein the energy stored in the energy storage device is provided to the motor to operate the motor to move the fan to circulate air through the compartment and past the heating coil for less than 15 minutes.

5. The infant care apparatus of claim 1, further comprising:

a heater switch operable to selectively connect the heating coil to at least one of the external power source and the energy storage device; and a controller operably connected to the heater switch to selectively operate the heater switch to disconnect the heating coil at least from the energy storage device.

6. The infant care apparatus of claim 5, wherein the heater switch is further operable by the controller to disconnect the heating coil from the external power source.

7. An infant care apparatus comprising:

an infant platform defining a compartment therein;

a heating coil disposed within the compartment;

an energy storage device operable to store energy;

a fan disposed within the compartment and configured to circulate air through the compartment and past the heating coil; and a motor physically connected to the fan and electrically connected to the energy storage device, wherein energy stored in the energy storage device is provided to the motor to operate the motor to move the fan to circulate air through the compartment and past the heating coil to cool the heating coil;

wherein the electrical energization from the energy storage device is provided solely to the motor.

8. The infant care apparatus of claim 7, wherein the heating coil, motor, and energy storage device are configured to receive electrical energization from an external power source and in the absence of the electrical energization from the external power source, the energy storage device provides electrical energization solely to the motor.

9. The infant care apparatus of claim 8, further wherein the heating coil is configured to produce heat upon receiving electrical energization from the external power source, the energy storage device is configured to store electrical energization from the external power source, and the motor is configured to drive the fan upon receiving electrical energization from the external power source.

10. The infant care apparatus of claim 8, wherein the energy storage device stores electrical energization from the external power source simultaneous to the heating coil producing heat energy from the electrical energization from the external power source.

11. An infant care apparatus comprising:

an infant platform defining a compartment therein;

a heating coil disposed within the compartment;

an energy storage device operable to store energy;

a fan disposed within the compartment and configured to circulate air through the compartment and past the heating coil; and a motor physically connected to the fan and electrically connected to the energy storage device, wherein energy stored in the energy storage device is provided to the motor to operate the motor to move the fan to circulate air through the compartment and past the heating coil to cool the heating coil;

wherein the energy storage device is a capacitor.

12. A method of operating an infant care apparatus for cleaning, the infant care apparatus comprising a convective heater with a heating coil and a fan operated by a motor, the method comprising:

connecting the convective heater to an external energy source; operating the heating coil with energization from the external energy source to generate heat;

charging an energy storage device from the external energy source;

disconnecting the convective heater from the external energy source by operating a switch with a controller to selectively disengage the heating coil from electrical energization;

providing energization from the energy storage device to the motor to operate the fan;

operating the fan to cool the heating coil with air circulated by the fan; and cooling the heating coil with air circulated by the fan.

13. The method of claim 12, further comprising operating the fan and heating coil with energization from the external energy source to achieve a predefined elevated temperature within a microenvironment, while charging the energy storage device.

14. The method of claim 12, further comprising cooling at least a portion of an infant platform of the infant care apparatus with the air circulated by the fan.

15. The method of claim 12, further comprising ceasing to provide energization to the heating coil after disconnection from the external power source.

16. A method of operating an infant care apparatus for cleaning, the infant care apparatus comprising a convective heater with a heating coil and a fan operated by a motor, the method comprising:

connecting the convective heater to an external energy source;

operating the heating coil with energization from the external energy source to generate heat;

charging an energy storage device from the external energy source;

operating a switch to interrupt the energization from the external energy source, then disconnecting the convective heater from the external energy source by operating a switch with a controller to selectively disengage the heating coil from electrical energization;

providing energization from the energy storage device to the motor to operate the fan;

operating the fan to cool the heating coil with air circulated by the fan; and cooling the heating coil with air circulated by the fan.

* * * * *